United States Patent [19]

Vetter

[11] Patent Number: 4,518,119

[45] Date of Patent: May 21, 1985

[54] SPRAYER

[75] Inventor: Kurt Vetter, Remseck, Fed. Rep. of Germany

[73] Assignee: Hermann Behr & Sohn GmbH & Co., Ingersheim, Fed. Rep. of Germany

[21] Appl. No.: 551,504

[22] Filed: Nov. 14, 1983

Related U.S. Application Data

[63] Continuation of Ser. No. 313,090, Oct. 20, 1981, abandoned.

[30] Foreign Application Priority Data

Oct. 24, 1980 [DE] Fed. Rep. of Germany ..... 3040136

[51] Int. Cl.[3] ..... B05B 3/10

[52] U.S. Cl. ..... 239/223; 239/703

[58] Field of Search ..... 239/700–703, 239/222.13, 223, 224, 498, 499, 524

[56] References Cited

U.S. PATENT DOCUMENTS 1,327,256 1/1920 Scheminger ..... 239/224

4,148,932 4/1979 Tada et al. ..... 239/700

4,214,708 7/1980 Lacchia ..... 239/703

FOREIGN PATENT DOCUMENTS 9985 of 1910 United Kingdom ..... 239/498

*Primary Examiner*—Andres Kashnikow

*Assistant Examiner*—Michael J. Forman

*Attorney, Agent, or Firm*—Martin A. Farber

[57] ABSTRACT

A rotatable, electrically chargeable, substantially bell-shaped sprayer for producing a paint mist from an axially fed liquid paint such as 2-component lacquers, for an apparatus for the electrostatic application of sprayed charged particles of the paint mist onto an article, the sprayer having an annular coaxial flowover surface for the liquid paint and an annular lip which projects axially forwardly on a radial and axial outer edge portion of the flowover surface. The lip is provided on its radial inside with grooves for channeling the flow of the liquid paint, the grooves being uniformly distributed on the circumference and extend approximately in the direction of the flow of the liquid paint. The grooves terminate open at a spray position of the lip and intersect in pairs.

9 Claims, 6 Drawing Figures

SPRAYER

RELATED APPLICATION

This is a continuation of my co-pending application Ser. No. 313,090 Filed: Oct. 20, 1981 now abandoned.

The present invention relates to a rotatable, electrically chargeable, substantially bell-shaped sprayer for producing a paint mist from an axially fed liquid paint such as 2-component lacquer, for an apparatus for the electrostatic application of sprayed charge particles of the paint mist onto an article, having an annular coaxial overflow surface for the liquid paint and having an annular lip which protrudes axially forward on the radial and axial outer edges of the overflow surface, the lip being provided on its radial inside with grooves for channeling the flow of liquid which are uniformly distributed on the circumference and extend approximately in the direction of flow of the liquid paint, said grooves terminating open at the spray point of the lip.

In one sprayer of this kind known from West German GS No. 80 00 844, the relatively short grooves extend in the natural direction of flow of the liquid paint, the individual streams of which are carried along in the grooves by the groove walls in circumferential direction so that there is no relative movement in circumferential direction.

The known sprayer has the disadvantage that when spraying liquid paint which consists, as in the case of 2-component lacquers, of at least two components, only incomplete mixing of the components in a static mixer may possibly take place before flowing over the overflow surface.

The object of the present invention is therefore to provide a sprayer of the aforementioned type which does away with this disadvantage for the application of paint.

This object is achieved in accordance with the invention in the manner that the grooves (32;132) intersect in pairs.

In this way there is advantageously obtained the result that the individual streams flowing in the grooves are mixed before they arrive at the spray point so that previously incompletely effected mixings are completed since the premixing is followed by a subsequent mixing.

Preferred embodiments of the sprayer of the invention are characterized by the fact that the grooves (32;132) are machined in a radially inwardly directed elevation (36; 136) of the lip (16; 116), the bottom (38; 138) of the grooves passing continuously into the overflow surface (30; 130). The particular advantage of these embodiments is that the individual streams which penetrate into the grooves from the overflow surface do not encounter there any discontinuities which unfavorably affect the conditions of flow such as are produced when the grooves are machined into non-elevated material.

It has been found advantageous for each groove (232) to intersect two to four other transversely extending grooves (232) at an angle ($\alpha$) of 30° to 90°, since in this way a particularly intensive aftermixing is effected. It is preferable for the grooves (232) to have a triangular cross section, the maximum width of groove (b) being 0.2 to 0.4 mm and the depth of groove (s) being half thereof, and for the width (l) of the lip (216) to be approximately twice the perpendicular distance (t) between centers of parallel grooves (232), as has been shown by actual trial.

The invention will be explained in detail below with reference to several illustrative embodiments of the sprayer of the invention, shown by way of example in the drawings, in which.

Figure 1:
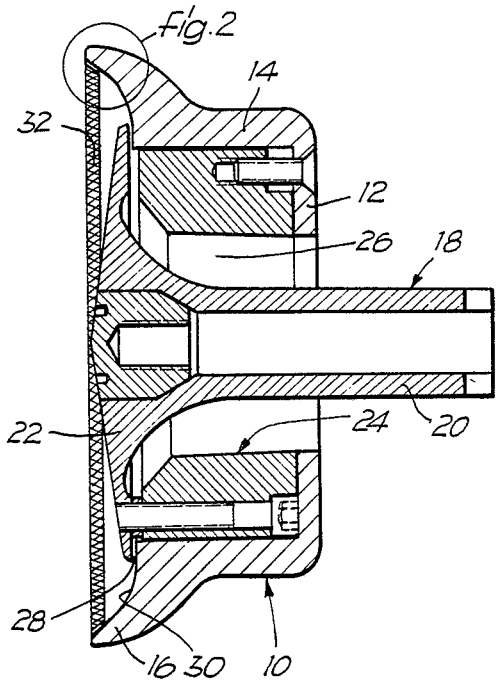
FIG. 1 is a central longitudinal section through a first embodiment.
Figure 2:
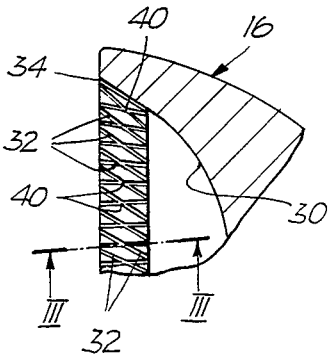
FIG. 2 is a portion of FIG. 1, shown on a larger scale.
Figure 3:
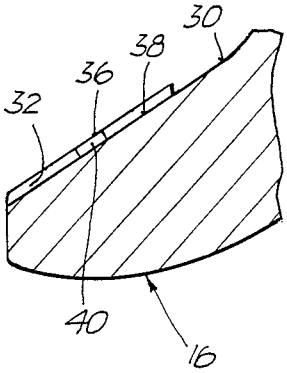
FIG. 3 is a fragmentary cross-section along the line III—III of FIG. 2 through the first embodiment.

The first embodiment, shown in FIGS. 1 to 3, comprises primarily a single-piece sprayer bell 10 with bottom 12, ring 14 and lip 16, a coaxial central part 18 with hub 20 and plate 22, and a coaxial intermediate part 24 which is gripped by the bell-ring 14 and is bolted, on the one hand, to the bell bottom 10 and, on the other hand, to the plate 22 of the central part 18. The central part 18 and the intermediate part 24 form an annular channel 26 which is initially axial and then, after deviation, radial and discharges through an annular slot 28, formed by the edge of the plate 22 and the bell ring 14, onto an annular coaxial concave overflow surface 30 which is formed by, in part, the ring 14 and, in part, the lip 16 of the sprayer bell 10.

The axially protruding lip 16 is located on the radial and axial outer edge of the overflow surface 30 and is provided on its radial inner side with linear grooves 32 distributed uniformly over the circumference, the grooves intersecting each other in pairs at an angle of 20°, at intersections 40, the bisector of the angle being perpendicular to an annular spray edge 34 of the lip 16. The grooves 32 are machined into a radially inwardly directed elevation 36 of the lip 16, the bottom of the grooves 38 passing smoothly without steps into the overflow surface 30.

Liquid paint sent through the channel 26 emerges through the annular slot 28 onto the overflow surface 30 on which it spreads out axially forward and radially outward in the form of a film, the flow of which is divided up by the grooves 32, a mixing of the individual streams taking place at the points of intersection 40 before they reach the sprayer edge 34.

Figure 4:
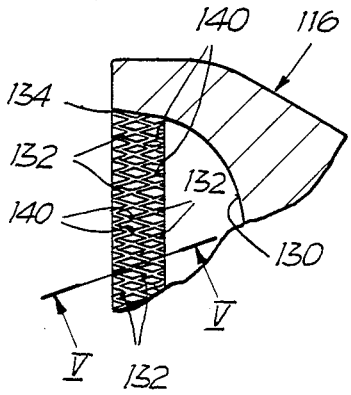
FIG. 4 is a portion corresponding to FIG. 2 of a longitudinal section through a second embodiment.
Figure 5:
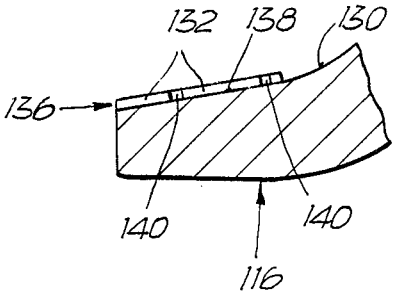
FIG. 5 is a cross-section corresponding to FIG. 3 along the line V—V of FIG. 4 through the second embodiment.

The second embodiment, shown in FIGS. 4 and 5, is in general identical to the first. Insofar as parts of the second embodiment shown agree or correspond with parts of the first embodiment, they have been designated by reference numbers which are higher by 100 and have not been again described.

One difference between the second and first embodiments is that in the second embodiment each groove 132 which forms part of a pair of intersecting grooves 132 intersects two parallel grooves 132 so that two coaxial circular rows of intersection points 140 are formed.

Figure 6:
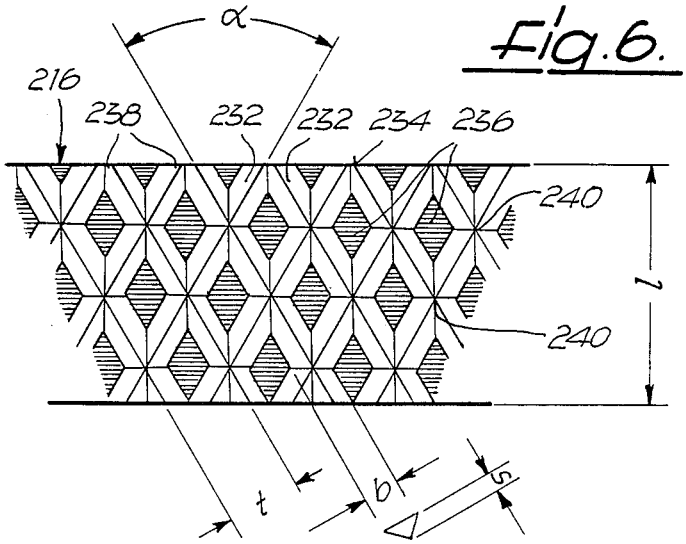
FIG. 6 is a fragmentary top view of the lip of a sprayer of the invention, shown in a developed projection.

FIG. 6 shows an arrangement of grooves in accordance with another embodiment of the invention to which the following dimensions of the development of the lip apply:

Width l of the lip 216 (with spray edge 234): 1.6 to 2.5×t Perpendicular distance t between two parallel groove bottoms 238: 0.5 to 0.8 mm Maximum width b of each groove 232: 0.4 to 0.8 mm Depth s of each groove, as well as height s of the elevation 236: 0.2 to 0.4 mm Angle of intersection ($\alpha$) between non-parallel grooves 232 30° to 90°.

Three points of intersection 240 are provided per groove 232. This groove arrangement is preferably produced by means of a knurling tool.

I claim:

1. In a rotatable, electrically chargeable, substantially bell-shaped sprayer for producing a paint mist from an axially fed liquid paint such as 2-component lacquers, for an apparatus for the electrostatic application of sprayed charged particles of the paint mist onto an article, the sprayer having an inner annular coaxial flowover surface for said liquid paint fed thereto via an inlet for the liquid paint and an annular lip which projects axially forwardly on a radial and axial outermost edge portion of the inner annular coaxial flowover surface, said outermost edge portion of the inner annular coaxial flowover surface being provided with grooves for channeling the flow of the liquid paint, the grooves being uniformly distributed on the circumference of said outermost edge portion of the inner annular coaxial flowover surface and extend approximately in the direction of the flow of said liquid paint, said grooves terminating open at a spray position of said lip, the improvement wherein said grooves form two sets of grooves, the grooves of each set extending substantially parallel to each other and intersecting said grooves of the other set of grooves at intersection regions, said grooves have a uniform cross-section along their entire length between said intersection regions, said grooves are substantially linear along their entire length, said outermost edge portion of the inner annular coaxial flowover surface has a substantially radially inwardly directed elevation on said flowover surface, said elevation defining a radially inwardly facing surface coaxial to said annular coaxial flowover surface, said grooves are formed in said elevation and have a bottom of the grooves passing continuously into an adjacent portion of said flowover surface, said grooves have a symmetrical V-shaped cross-section and divide said elevation into a plurality of substantially truncated pyramids arranged substantially parallel to each other and each of said truncated pyramids having four lateral sides with a parallelogram base, only two adjacent sides of adjacent of said pyramids respectively defining the V-shaped and uniform cross-section and linearity of the grooves along their entire length between said intersection regions, and said grooves disposed for channelling said liquid paint into at least a first and a second coherent thread of liquid, each of said threads extending beyond said sprayer edge by a measurable distance and substantially all of said threads extending substantially the same said measurable distance beyond said sprayer edge.

2. The sprayer as set forth in claim 1, wherein each of said grooves of each of said sets intersects two to four other said grooves of the other of said sets at an angle of 30° to 90°, said other grooves extend substantially transversely to said each groove.

3. The sprayer as set forth in claim 2, wherein the width of said outermost edge portion of the inner annular coaxial flowover surface is approximately twice the perpendicular distance between centers of adjacent of said parallel grooves.

4. The sprayer as set forth in claim 1, wherein each of said grooves has a triangular cross section with its apex at said bottom of said grooves, the maximum width of each of said grooves is 0.2 to 0.4 mm and the depth of each of said grooves is half of said maximum width.

5. The sprayer as set forth in claim 4, wherein the width of said outermost edge portion of the inner annular coaxial flowover surface is approximately twice the perpendicular distance between centers of adjacent of said parallel grooves.

6. The sprayer as set forth in claim 1, wherein an imaginary bisector of the angle between said intersecting grooves is perpendicular to the outermost edge portion of said flowover surface.

7. The sprayer as set forth in claim 1, wherein said inlet extends substantially radially to said flowover surface.

8. The sprayer as set forth in claim 1, wherein said substantially radially inwardly directed elevation has a uniform thickness from said flowover surface to said radially inwardly facing surface of said substantially radially inwardly directed elevation, said elevation is divided by said intersecting grooves into said plurality of pyramids each having said four lateral sides constituting substantially laterally facing surfaces aligned and parallel respectively to corresponding of said laterally facing surfaces of said adjacent of said pyramids defining therebetween said uniform cross-section and linearity of said grooves.

9. The sprayer as set forth in claim 8, wherein each of said four lateral sides of each of said truncated pyramids have the same length, said parallelogram bases of said pyramids having equal sides.

* * * * *